United States Patent [19]

Buckwalter

[11] Patent Number: 4,709,495

[45] Date of Patent: Dec. 1, 1987

[54] SEPARATOR MEANS FOR FRAMELIKE DEVICES

[76] Inventor: Kendrick Buckwalter, 18 Chetwynd Rd., Paoli, Pa. 19301

[21] Appl. No.: 406,101

[22] Filed: Aug. 6, 1982

[51] Int. Cl.[4] ..... A47G 1/06

[52] U.S. Cl. ..... 40/158 R; 40/160; 40/152

[58] Field of Search ..... 40/152, 158 R, 219, 40/156, 559, 160, 613, 615, 618, 155, 154, 204, 209, 10 D; 52/788; 428/34, 14, 45, 81, 192, 138, 156, 119, 120, 178, 188, 347; D6/300, 314; 296/95 R

[56] References Cited

U.S. PATENT DOCUMENTS

| | | | |
|---|---|---|---|
| 153,158 | 7/1874 | Conant | 40/152 |
| 315,703 | 4/1885 | Bencke et al. | 40/152 |
| 349,193 | 9/1886 | Young | 40/615 |
| 355,510 | 1/1887 | Dalton | 40/615 |
| 470,222 | 3/1892 | Townsend | 40/160 |
| 589,695 | 9/1897 | Carraine | 40/152 |
| 636,319 | 11/1899 | Camp | 40/158 |
| 710,741 | 10/1902 | Berninger | 40/616 |
| 764,273 | 7/1904 | Denton | 40/152 |
| 920,593 | 5/1909 | Leslie | 40/160 |
| 1,048,343 | 12/1912 | Rice | 40/618 |
| 1,202,593 | 10/1916 | Scott | 40/219 |
| 1,353,363 | 9/1920 | Simon | 40/453 |
| 1,777,435 | 10/1930 | Hogelund | 40/10 R |
| 1,875,964 | 9/1932 | Walsh | 428/81 |
| 2,019,098 | 10/1935 | Schrickel | 40/160 |
| 2,026,708 | 1/1936 | Rubin | 40/160 |
| 2,061,309 | 11/1936 | King | 40/427 |
| 2,268,351 | 12/1941 | Tanaka | 40/563 |
| 2,441,831 | 5/1948 | Moore | 428/34 |
| 2,520,437 | 8/1950 | Sachs | 40/158 R |

(List continued on next page.)

FOREIGN PATENT DOCUMENTS

| | | | |
|---|---|---|---|
| 99595 | 11/1924 | Austria | 40/160 |
| 186390 | 10/1955 | Austria | 40/160 |
| 612560 | 1/1961 | Canada | 52/788 |
| 815956 | 7/1936 | France | 40/219 |
| 870362 | 3/1942 | France | 40/160 |
| 947417 | 7/1949 | France | 40/160 |
| 1343309 | 10/1963 | France | 40/160 |
| 254278 | 4/1948 | Switzerland | 40/615 |
| 307247 | 8/1955 | Switzerland | 52/788 |
| 12336 | 5/1899 | United Kingdom | 40/559 |
| 8242 | 4/1903 | United Kingdom | 40/615 |
| 8940 | of 1911 | United Kingdom | 40/152 |
| 336018 | 10/1930 | United Kingdom | 40/152 |
| 386726 | 1/1933 | United Kingdom | 40/615 |
| 963140 | 7/1964 | United Kingdom | 40/219 |
| 1431439 | 4/1976 | United Kingdom | 40/160 |

OTHER PUBLICATIONS

Decor, Mar. 1981, p. 298, "Framespace".

Decor, Apr. 1980, Advertisement for "Bendix Mouldings Inc".

Decor, Feb. 1980, Advertisement for "AR-T-O-RAMA".

Decor, Apr. 1980, Advertisement for "Process Materials Corp."

*Primary Examiner*—Gene Mancene

*Attorney, Agent, or Firm*—William R. Cleaver

[57] ABSTRACT

The present arrangement provides a clear separator or separators to be used with a framelike device to display pictures, diplomas, crewel work and other displayable items. Each of the clear separators a clear separators has three dimenions. Along length and width it is formed to fit the shelf sections of a frame or other holder. Each of the separators has adhesive material secured to one surface defined by its length and width so that when it is pressed onto a transparent member, such as a piece of glass, which is already resting on the shelf of the framelike device, it adheres to the glass and lies along the shelf position. In this way, it is not readily viewable through the transparent member. The item to be displayed lies in abutment with the separators and is separated from the transparent member by the depth of the separators.

3 Claims, 4 Drawing Figures

| | | | |
|---|---|---|---|
| 2,556,798 | 6/1951 | Concordet | 40/160 |
| 2,579,230 | 12/1951 | Giboney | 40/204 |
| 2,741,046 | 4/1956 | Kroslak | 40/209 |
| 2,867,053 | 1/1959 | Boor | 40/615 |
| 3,137,080 | 6/1964 | Zang | 40/160 |
| 3,205,598 | 9/1965 | Grosse | 40/613 |
| 3,271,232 | 9/1966 | Moore | 428/192 |
| 3,292,292 | 12/1966 | Engelstein | 40/158 R |
| 3,312,023 | 4/1967 | Zell | 296/95 R |
| 3,314,180 | 4/1967 | Porter | 40/615 |
| 3,382,595 | 5/1968 | Shore | 40/158 R |
| 3,425,147 | 2/1969 | Marx | 40/155 |
| 3,503,147 | 3/1970 | Herrin et al. | 40/160 |
| 3,707,053 | 12/1972 | Itano | 40/158 R |
| 3,787,992 | 1/1974 | Leonhardt | 40/152 |
| 3,789,529 | 2/1974 | Thom | 40/158 R |
| 3,792,543 | 2/1974 | Powell | 40/160 |
| 3,797,152 | 3/1974 | Brandt | 40/158 R |
| 4,109,431 | 8/1978 | Mazzoni et al. | 428/34 |
| 4,144,664 | 3/1979 | De Korte | 40/10 D |
| 4,145,829 | 3/1979 | Peltier | 40/158 R |
| 4,172,749 | 10/1979 | Liggett | 428/119 |
| 4,192,905 | 3/1980 | Scheibal | D6/300 |
| 4,204,015 | 5/1980 | Wardlaw et al. | 428/119 |
| 4,215,499 | 8/1980 | Wilson | 40/158 R |
| 4,292,352 | 9/1981 | Singer | 40/158 R |
| 4,325,230 | 4/1982 | Driscoll et al. | 428/178 |
| 4,356,650 | 11/1982 | Anonczyk et al. | 40/156 |
| 4,475,296 | 10/1984 | Fremstad | 40/152 |

SEPARATOR MEANS FOR FRAMELIKE DEVICES

BACKGROUND

In the art of framing pictures, diplomas, crewel work or other displayable items, it has been understood that very often moisture condenses between the transparent member, for example a glass member, of the package and the item, i.e., a picture, to be displayed. If there is no separation or merely the separation of a relatively thin cardboard mat, then very often the picture, or item to be displayed, clings to the transparent member by virtue of the water condensed out and lying therebetween. In such circumstances, the picture is very often damaged.

In the prior art there has been some attempt to overcome the problem by using cardboard separators and separators made of balsa wood or even a relatively thick matting material. Each of these solutions has been burdened with infirmities. For instance, the balsa wood separator absorbs water and becomes acidic thereby discoloring the item that is being displayed. In addition, the balsa wood has to be painted to some suitable color lest it detracts from the picture or item to be displayed. In addition, the balsa wood is normally fastened with some form of clip. The cardboard separator and the relatively thick molding material change the aesthetics of the picture because for instance, the matting material overlaps the picture and both the cardboard separators and the matting material need to be colored properly so as not to detract from the picture. In addition, the cardboard and the matting material absorb water and often become mildewed as any wet paper item will.

The present invention is a clear plastic so there is no distraction from the picture because the color of the picture or the color of the item to be displayed is picked up by this clear plastic separator. The separator being plastic does not lend itself to absorbing water and hence, does not become acidic as does the balsa wood nor does it become mildewed as do the paper products. The present invention is formed to readily adhere to the glass or transparent member and it can be stacked to provide greater depth for greater separation between the transparent member and the item to be displayed.

SUMMARY

The present invention provides clear plastic separators, each of which has, in one embodiment, adhesive material on one surface so that the separator can be simply pressed against the transparent member and held in place or in the alternative numbers of separators can be stacked on top of one another and held in place to provide more space between the transparent member and the item to be displayed. The present invention in another embodiment has adhesive material on two orthogonal surfaces so that the separator can be secured to the transparent member and can also be secured to the side wall of the shelf of the frame. The plastic separators of the present invention assume the color of the item to be displayed, such as a picture, and therefore, eliminate the neccessity to properly color a separator device. Since the separators of the present invention are plastic, they do not absorb water and they do not become mildewed or acidic or have any negative reactions with moisture which may be condensed between the transparent member and the item to The objects and features of the present invention will be better understood in accordance with the following description taken in conjunction with the drawings wherein:

Figure 1:
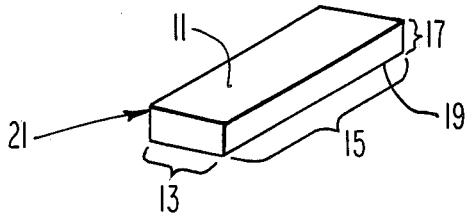
FIG. 1 shows the plastic separator of the present invention.

Consider FIG. 1 which shows a plastic separator 11. The plastic separator 11 is a 3-dimensional device having a width 13, a length 15, and a depth 17. In a preferred embodiment, the width is 3/16 inch and the depth is $\frac{1}{8}$ inch and the length is variable depending upon the use of the frames which are currently in demand. It should be understood that other dimensions can be used. While the separator 11 is shown in an elongated, rectangular shape, it should be understood that it could have other configurations such as curved, etc. if the shelf or the rabbet has a preculiar shape or configuration. In normal framing devices, the frames are rectangular and hence, the separator 11 is shown in a substantially rectangular fashion.

The separator 11 is made of a clear plastic material such as plexiglass or the like and on one surface, such as the undersurface 19, there is an adhesive material secured to the separator 11. The adhesive material can be a product identified as 463 Adhesive Transfer Tape manufactured by the 3M Company but it could be any other adhesive material which would permit the adhesive to stick to both the separator and to the transparent medium as should become apparent hereinafter. By using the 463 Adhesive Transfer Tape, the adhesive is applied to the undersurface 19 and it has a tape over the second sticky side. The user waits until he wants to secure the separator against the transparent member and simply peels off the tape and presses the separator against the transparent medium. In some embodiments, the adhesive material is also applied to the depth side 21 so that when the tape is peeled off the underside 19 and the orthogonal side 21, the separator can be secured in a right angle corner, i.e., the top surface of the transparent member and the vertical wall of the picture frame.

Figure 2:
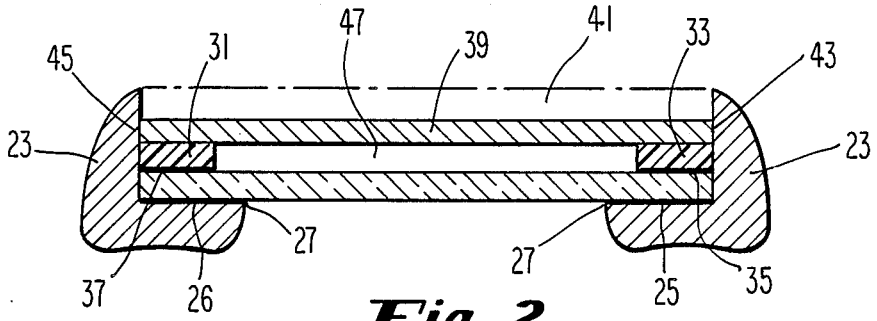
FIG. 2 is the end view of a frame in cross-section showing a transparent member, two separators in accordance with the present invention and an item to be displayed.

Consider FIG. 2 which shows the cross-section of a frame 23. The frame 23 has a shelf or a rabbet 25 on the right hand side and rabbet 26 on the left hand side. Actually, the shelf is a continual shelf around the inside of the frame and the inner edge of the shelf 27 defines an aperture through which the viewer looks at the item to be displayed. In FIG. 2, there is shown a transparent member 29 mounted on the shelf sections 25 and 26. The transparent member 29 may be glass, or it may be some transparent plastic which is well understood in the art. Secured to the transparent member 29 are two clear plastic separators 31 and 33 which have been pressed and secured to the transparent member 29 by virtue of the adhesive which is shown by and exaggerated wrinkled lines 35 and 37. On top of the clear plastic separators 31 and 33, there is located an item to be displayed, for instance, a picture 39. Shown in phantom in back of the picture is the blocking piece 41 which locks the entire package into the frame 23. When the viewer looks at the picture 39 through the transparent member 29, the viewer is not distracted by the clear plastic separators 31 and 33, because those separators assume the color of the picture which lies behind them. The fact that there is no requirement to make the separator into a particular color or at least into a non-offensive color, is a decided advantage of the plastic separators of the present invention over the cardboard separators and balsa wood separators of the prior art. Another advantage of using the separators 31 and 33, is that the picture 39 and the transparent member can be cut to the dimensions of the frame and therefore, fitted snugly within the sidewalls 43 and 45 of the frame without having to be concerned about correcting the picture size or the transparent member to accommodate the width or other dimension of a separator as is required with some prior art separators. As can be understood from this arrangement shown in FIG. 2, the separators 31 and 33 provide a space 47 between the transparent member 29 and the picture 39. If indeed, moisture should be condensed within the space 47, the plastic separators 31 and 33 do not absorb that moisture and therefore, do not become acidic or mildewed or in any way have a negative reaction because of the presence of the moisture.

Figure 3:
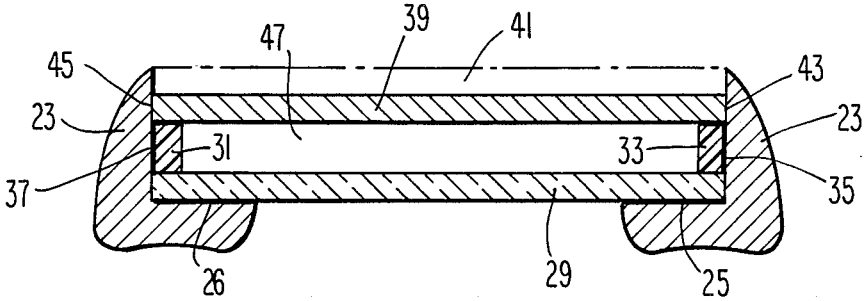
FIG. 3 depicts the separator used in another mode to provide more separation between the transparent member and the item to be displayed.

If for whatever reasons might be required, the user were to desire a larger space 47, then additional plastic separators such as 31 and 33, can be stacked one on top of the other to provide a wider space 47. Another way to accomplish the wider space 47 is to use the plastic separators as they are shown in FIG. 3. In FIG. 3, we find the frame 23 and mounted on the shelves or rabbets thereof is the transparent member 29. However, in FIG. 3, the plastic separators are standing on end, that is, on their depth side and the adhesive material 35 and 37 is shown adhering to the side walls respectively 43 and 45 of the frame 23. In this way, the width 13 becomes the width of the space 47 and that is a greater width than the depth distance such was shown in FIG. 2. In accordance with the description above in the preferred embodiment, the width 13 would be 3/16 inch and hence, the space 47 to be 3/16 inch. As mentioned earlier, it should be understood that other widths and other depths could be used.

Figure 4:
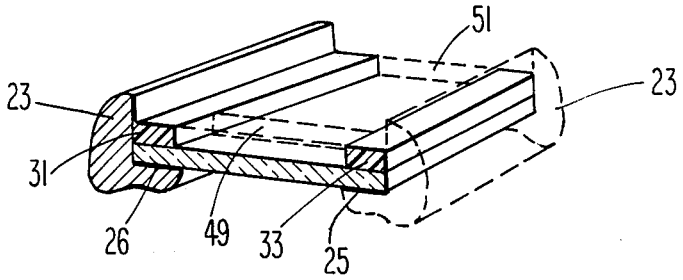
FIG. 4 is a pictorial schematic showing the arrangement of four separators of the present invention in position to hold an item to be displayed.

FIG. 4 is a pictorial which shows one section of the frame 23 in sectional form and another section of the frame 23 in phantom. It will be noted in FIG. 4 that there is the transparent member 29 mounted on the shelves or rabbets 25 and 26. Also in FIG. 4, there are shown the two plastic separators 31 and 33 mounted as shown in FIG. 2. In addition in FIG. 4, there are shown two plastic separators 49 and 51 in phantom. The arrangement of the plastic separators 49 and 51 is depicted so that it can be seen that the separators provide a complete support for the item to be displayed. It is conceivable that the plastic separators could be mitered at the ends so that the corners would fit in a mitered fashion but this would add to the cost and it is simpler to provide different lengths of the plastic devices or alternatively they can be readily cut off to the proper length so that they fit as shown in FIG. 4. The item to be displayed is not shown in FIG. 4 in order to render the pictorial in a simple form to show the additional plastic separators 49 and 51.

The present invention enables the professional framer or the amateur framer to readily provide a space between the transparent member and the item to be displayed which separator will be readily be put in place because of the adhesive aspect thereof and which separator will not detract from the picture because of color conflicts and which separator will not provide a basis for damage to the picture because of acidity or mildew or any other reactions related to moisture condensation.

What is claimed is:

1. A means for displaying a two dimensional item comprising in combination: three dimensional frame means formed to a particular configuration in a two dimensional sense and having an outer edge and an aperture therewithin defined by an inner edge; said three dimensional frame means being further formed to have a horizontal shelflike section which has length and width dimensions being defined by said inner edge and by a line lying between said inner edge and said outer edge; said three dimensional frame means further formed to have a vertical wall section disposed to rise vertically from said line in a third dimension to thus define a depth dimension for said horizontal shelflike section; transparent means formed to fit completely over said aperture in abutment with said horizontal shelflike section and in close proximity to said vertical wall section; a plurality of three dimensional clear separator means formed to be individual from each other and disposed to be unattached to each other, each of said three dimensional clear separator means having length, width and depth dimensions with at least one of said separators being formed so that its length dimension is less than the length of an associated part of said shelflike section and each disposed to come in abutment with said transparent means in alignment with an associated part of said shelflike section, said three dimensional clear separator means further formed of material which does not absorb moisture and which can be readily cut to enable any of said three dimensional clear separator means to be cut to a length to approximately match an associated part of said shelflike section; pressure sensitive adhesive means disposed on a front surface of each three dimensional clear separator means, which front surface is defined by the length and width dimensions of such three dimensional clear separators to then enable each three dimensional clear separators to be pressure secured along its front surface to said transparent means and alternatively to be removed therefrom whereby, when said plurality of three dimensional clear separator means are secured to said transparent means, a two dimensional item to be displayed can be disposed to overlay said plurality three dimensional clear separator means, and can be separated from said transparent means by the depth of said three dimensional clear separator means.

2. A means for displaying a two dimensional item according to claim 1 wherein at least one of said three dimensional clear separator means is of different length than others of said three dimensional clear separator means.

3. A means for displaying a two dimensional item according to claim 1 wherein said pressure sensitive adhesive is further disposed along said depth dimension of each of said three dimensional clear separators to thus enable said three dimensional clear separators to be pressure secured to the depth dimension of said shelflike section and alternatively to be removed therefrom.

* * * * *